US010525749B1

(12) United States Patent
Hamelin et al.

(10) Patent No.: US 10,525,749 B1
(45) Date of Patent: Jan. 7, 2020

(54) PRINTING SYSTEM HAVING A PRINT BED AND A SHIELDING PANEL

(71) Applicant: The Gillette Company LLC, Boston, MA (US)

(72) Inventors: Michel Denis Hamelin, West Roxbury, MA (US); Janelle Marie Parechanian, Revere, MA (US); Randy LaCaze, Owens Cross Roads, AL (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/228,327

(22) Filed: Dec. 20, 2018

(51) Int. Cl.
*B41J 25/00* (2006.01)
*B41J 29/13* (2006.01)
*B41J 29/02* (2006.01)

(52) U.S. Cl.
CPC ..... *B41J 25/001* (2013.01); *B41J 29/02* (2013.01); *B41J 29/13* (2013.01)

(58) Field of Classification Search
CPC ..... B41J 25/001; B41J 29/02; B41J 29/13
See application file for complete search history.

(56) References Cited

U.S. PATENT DOCUMENTS

2015/0360462 A1* 12/2015 Lowrance ..... B41J 3/28 101/425

* cited by examiner

*Primary Examiner* — Thinh H Nguyen
(74) *Attorney, Agent, or Firm* — Kevin C. Johnson

(57) ABSTRACT

A printing system includes a base, a print head assembly, a print bed, and a shielding panel. The print head assembly is slidably coupled with the base and is slidable along a longitudinal path. The print head assembly includes a print head that is configured to selectively dispense a printing medium therefrom. The print bed is slidably coupled with the base and is slidable along a lateral path between a retracted and extended position. The print bed includes a lower tray that includes an outer edge. The shielding panel includes an upper surface. The shielding panel overlies at least a portion of the outer edge of the lower tray. The upper surface of the shielding panel is formed of a light absorbent material that has a hemispherical reflectance of between about 0% and about 5% for a light spectrum range of between about 220 nm and about 400 nm.

20 Claims, 7 Drawing Sheets

PRINTING SYSTEM HAVING A PRINT BED AND A SHIELDING PANEL

FIELD OF INVENTION

The apparatus described below generally relates to a printing system for printing on a contoured object. The printing system includes a print bed and one or more shielding panels associated with the print bed.

BACKGROUND OF THE INVENTION

Conventionally, when an inkjet printer prints on contoured objects, the print quality on the contoured surfaces is poor due to the turbulence caused by movement of the print head assembly during printing. In addition, when a curing lamp is employed to enhance the cure times of the printed ink on the contoured objects, ink droplets can inadvertently be deposited on the print heads of the inkjet printer and become cured by the effect of reflected stray UV light which can cause premature failure of the print heads. Some examples of these conventional systems can be found in U.S. Pat. Nos. 9,302,506 and 9,272,815, U.S. Pat. Pub. Nos. 2016/0052312 and 2016/0147153, "Reducing Light Reflection—Technical Note—Phoseon Technology", Phoseon Document No. 29321 Rev 6.0, and "Characterization of the Reflectivity of Various Black Materials", Marshall et al.

SUMMARY OF THE INVENTION

In accordance with one embodiment, a printing system comprises a base, a print head assembly, a print bed, and a first shielding panel. The print head assembly is slidably coupled with the base and is slidable along a longitudinal path. The print head assembly comprises a print head that is configured to selectively dispense a printing medium therefrom. The print bed is slidably coupled with the base and is slidable along a lateral path between a retracted position and an extended position. The print bed comprises a lower tray and a substrate, the lower tray comprising an outer edge and the substrate configured to support an article thereon for printing upon. The first shielding panel is coupled with the base adjacent to the print bed and comprises an upper surface. The first shielding panel overlies at least a portion of the outer edge of the lower tray when the print bed is in the retracted position. The upper surface of the first shielding panel is formed of a light absorbent material that has a hemispherical reflectance of between about 0% and about 5% for a light spectrum range of between about 220 nm and about 400 nm. In one alternative of such an embodiment, a first plane intersects the upper surface and is substantially parallel with the longitudinal path and the lateral path. The print head comprises a lower surface, a second plane intersects the lower surface and is parallel with the first plane. The first plane is spaced from the second plane by between about 1 mm and about 5 mm. In another alternative of such an embodiment, the printing system further comprises a second shielding panel coupled with the base adjacent to the print bed and comprises an upper surface. The first and second shielding panels are angled with respect to each other. In yet another alternative of such an embodiment, the first shielding panel defines a plurality of apertures.

In accordance with another embodiment, a printing system comprises a base, a print head assembly, a print bed, and a first shielding panel. The print head assembly is slidably coupled with the base and is slidable along a longitudinal path. The print head assembly comprises a print head that is configured to selectively dispense a printing medium therefrom. The print bed is slidably coupled with the base and is slidable along a lateral path between a retracted position and an extended position. The print bed comprises a lower tray and a substrate, the lower tray comprising an outer edge and the substrate configured to support an article thereon for printing upon. The first shielding panel is coupled with the print bed and comprises an upper surface. The first shielding panel overlies at least a portion of the outer edge of the lower tray. The upper surface of the first shielding panel is formed of a light absorbent material that has a hemispherical reflectance of between about 0% and about 5% for a light spectrum range of between about 220 nm and about 400 nm.

In accordance with yet another embodiment, a printing system comprises a base, a print head assembly, a print bed, a right shielding panel, a left shielding panel, a front shielding panel, and a rear shielding panel. The base comprises a right side and a left side. The print head assembly is slidably coupled with the base and is slidable along a longitudinal path. The print head assembly comprises a print head that is configured to selectively dispense a printing medium therefrom. The print bed is slidably coupled with the base and is slidable along a lateral path between a retracted position and an extended position. The print bed comprises a front end, a rear end, a lower tray, and a substrate, the lower tray comprising an outer edge and the substrate configured to support an article thereon for printing upon. The right shielding panel comprises an upper surface and is coupled with the right side of the base such that the print bed slides relative to the right shielding panel. The left shielding panel comprises an upper surface and is coupled with the left side of the base such that the print bed slides relative to the left shielding panel. The left shielding panel is spaced longitudinally from the right shielding panel. The front shielding panel comprises an upper surface and is coupled with the front end of the print bed. The rear shielding panel comprises an upper surface and is coupled with the rear end of the print bed and is spaced laterally from the front shielding panel. Each of the front shielding panel and the rear shielding panel overlies at least a portion of the outer edge of the lower tray. Each of the right shielding panel and the left shielding panel overlies at least a portion of the outer edge of the lower tray when the print bed is in the retracted position. The upper surface of each of the front shielding panel, the rear shielding panel, the right shielding panel, and the left shielding panel is formed of a light absorbent material that has a hemispherical reflectance of between about 1% and about 2% for a light spectrum range of between about 220 nm and about 400 nm.

BRIEF DESCRIPTION OF THE DRAWINGS

It is believed that certain embodiments will be better understood from the following description taken in conjunction with the accompanying drawings in which.

DETAILED DESCRIPTION OF THE INVENTION

Figure 1:
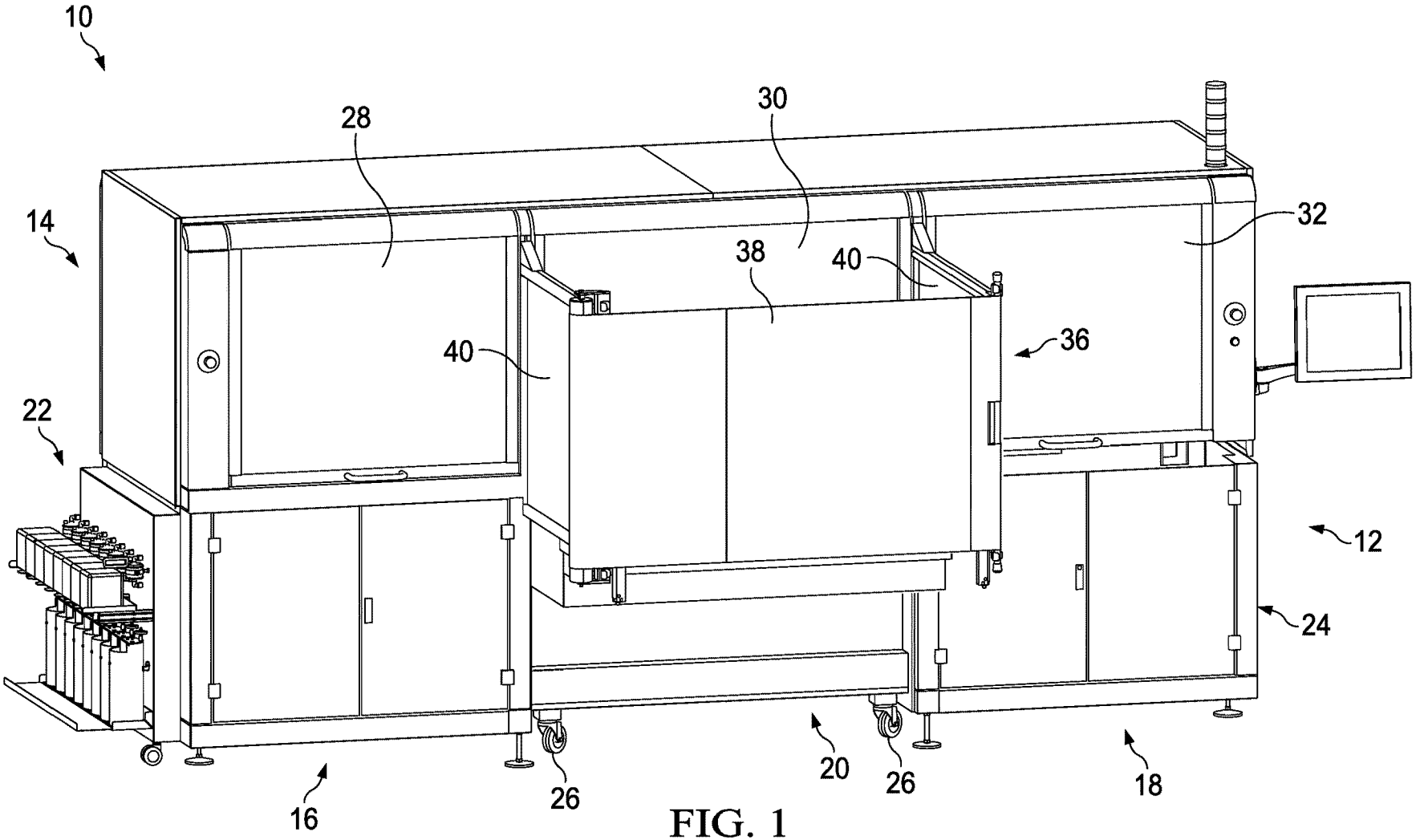
FIG. 1 is an isometric view depicting a printing system, in accordance with one embodiment.
Figure 2:
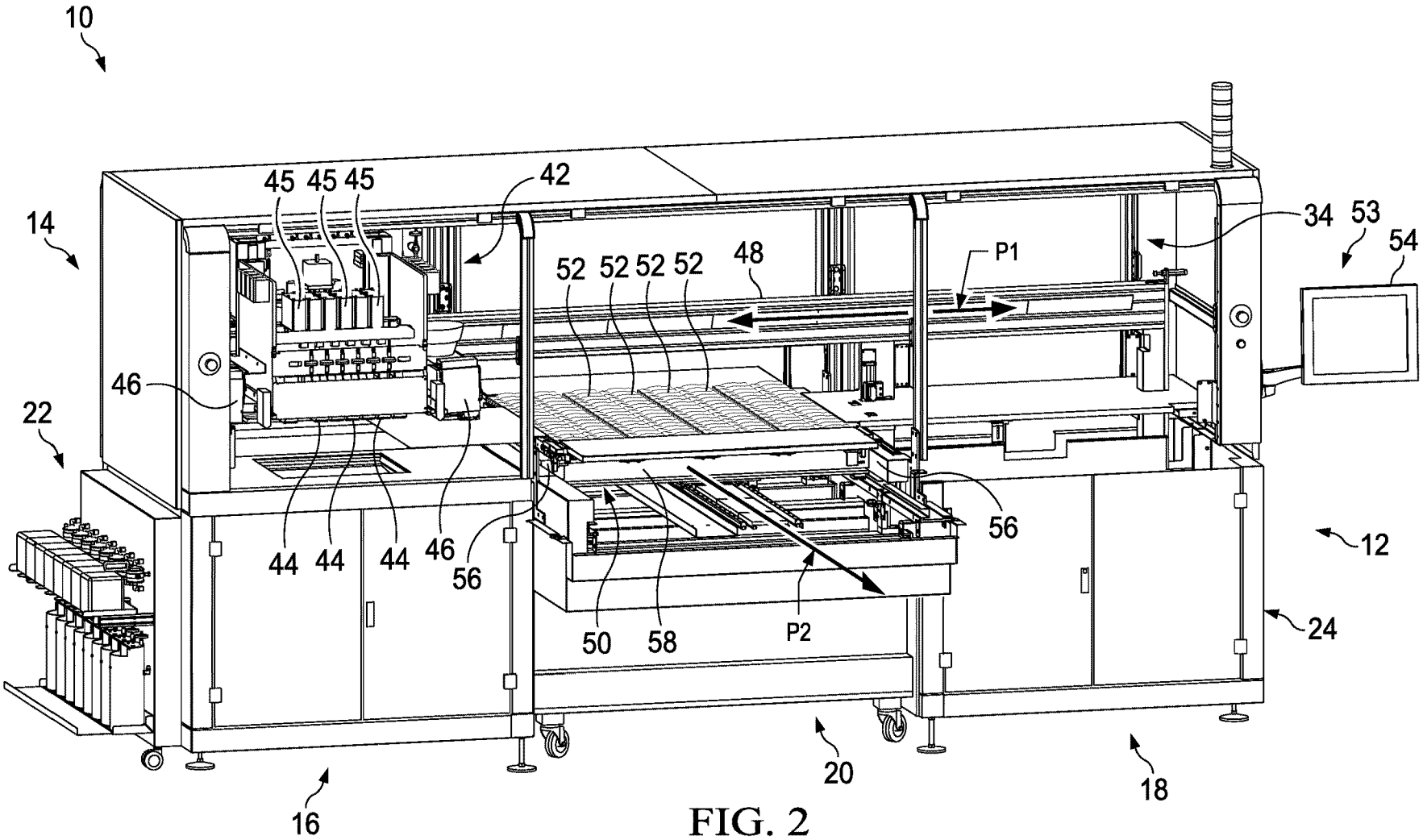
FIG. 2 is an isometric view depicting the printing system of FIG. 1 with certain components removed for clarity of illustration and with a print bed shown in a retracted position and a print head assembly shown in a home position.

In connection with the views and examples of FIGS. 1-7, wherein like numbers indicate the same or corresponding elements throughout the views, a printing system 10 is shown in FIG. 1 to include a base 12 and an upper shroud 14. The base 12 can include left and right cabinet units 16, 18 and a central frame portion 20 disposed between the left and right cabinet units 16, 18. The left and right cabinet units 16, 18 can be disposed at left and right sides 22, 24, respectively, of the base 12. A plurality of wheels 26 (two shown) can be coupled with the central frame portion 20 to enable selective transportation of the printing system 10. The upper shroud 14 can include a left door 28, a central door 30, and a right door 32 which can each be selectively opened (or removed from the upper shroud 14 entirely) to reveal an interior 34 (FIG. 2). A curtain assembly 36 can be disposed in front of the central door 30 and can extend outwardly from the base 12. The curtain assembly 36 can include a front curtain 38 and a pair of side curtains 40 that cooperate to substantially surround the central door 30.

Referring now to FIG. 2, the printing system 10 can include a print head assembly 42 that is disposed within the interior 34 and includes a plurality of print heads 44 that are in fluid communication with a plurality of reservoirs 45. Each of the reservoirs 45 can contain ink and can be configured to feed ink to at least one of the print heads 44. The print heads 44 can be configured to selectively dispense the ink from the reservoir(s) 45 to facilitate inkjet printing with the print head assembly 42. The ink dispensed from the print heads 44 can be curable with light. As such, the print head assembly 42 can also include a pair of curing lamps 46 that are disposed adjacent to the print heads 44 and are configured to emit light to an area beneath the print heads 44 to facilitate curing of the dispensed ink during inkjet printing. In one embodiment, the curing lamps 46 can be configured to emit UV light that is between about 10 nm and about 440 nm and preferably between about 220 nm and about 440 nm. In such an embodiment, the ink can be configured to be ultra-violet (UV) curable ink that is curable at the spectral wavelength emitted by the curing lamps 46.

The print head assembly 42 can be slidably coupled with the base 12 via a gantry 48 such that the print head assembly 42 is slidable along a longitudinal path P1. A print bed 50 can be coupled with the central frame portion 20 and disposed beneath the gantry 48 such that the print head assembly 42 can slide along the gantry 48 and over the print bed 50. While the printing process can be used on many different articles (including but not limited to razors, pens, toothbrushes, bottles or packages, etc.) that have contoured surfaces, flat surfaces (e.g., paper), or some combination of both, in one embodiment, the printing is shown to be performed on a plurality of razor handles 52. The plurality of razor handles are shown to be distributed along the print bed 50 to allow for printing of indicia or other markings on the razor handles 52 by the print head assembly 42.

Figure 4:
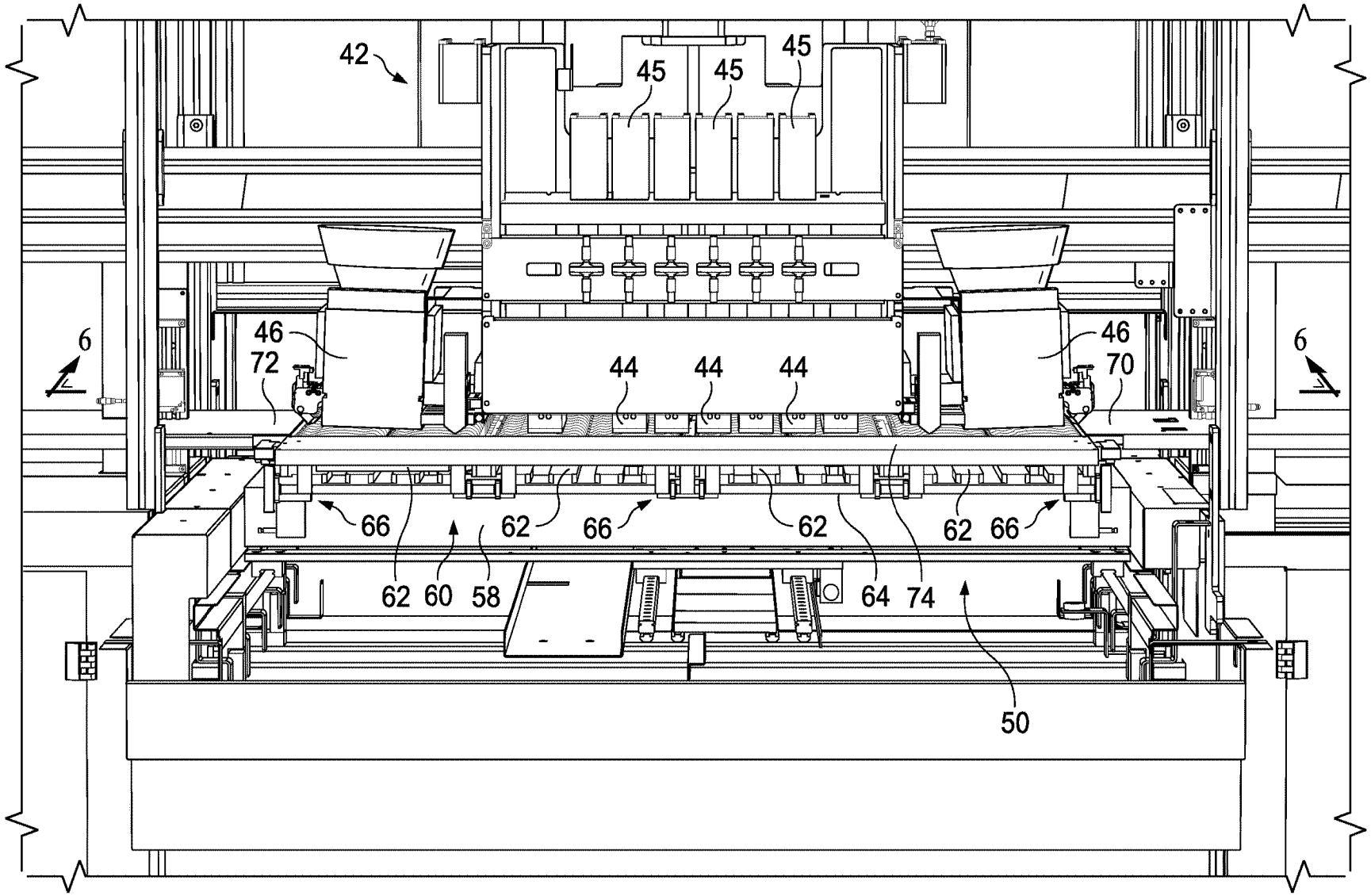
FIG. 4 is a front isometric view depicting the printing system of FIG. 2 but with the print head assembly shown in a printing position.

Prior to initializing a printing operation, the print head assembly 42 can be maintained in a home position, as illustrated in FIG. 2. When in the home position, the print head assembly 42 can be horizontally spaced from the print bed 50 and provided at a location (e.g., at the left side 22 of the base 12) that allows for manual access to the print head assembly 42 to perform maintenance (e.g., replenish the ink in the reservoir) or to allow for some other manual operation on the print head assembly 42. When printing is initialized, the print head assembly 42 can first move to the printing position, as illustrated in FIG. 4, such that the print head assembly 42 is disposed above the print bed 50. The print head assembly 42 can then move along the print bed 50 while selectively dispensing ink from the print heads 44 (via the reservoirs 45) to facilitate printing on each of the razor handles 52. The curing lamps 46 can selectively illuminate the print bed 50 in conjunction (e.g., simultaneously) with the printing of the razor handles 52 to facilitate curing of the ink.

During the printing operation, the left, central, and right doors 28, 30, 32 can be closed (as illustrated in FIG. 1) to enclose the interior 34, thereby discouraging external contaminants from infiltrating the printing operation, as well as discouraging byproducts of the printing process from escaping from the upper shroud 14. In addition, the curtain assembly 36 can substantially surround the central door 30 (as illustrated in FIG. 1) to diffuse and/or shield any UV light that escapes from the central door 30 during the printing process.

Once the printing operation is complete, one or more of the front curtain 38 and the side curtains 40 of the curtain assembly 36 can be opened or removed to gain access to the central door 30. The central door 30 can then be opened (or removed from the upper shroud 14 as illustrated in FIG. 2) to gain access to the print bed 50. The razor handles 52 that have been printed upon (i.e., completed razor handles 52) can then be unloaded from the print bed 50 and replaced with razor handles (e.g., 52) that are ready for printing (i.e., incomplete razor handles).

Referring again to FIG. 2, the print system 10 can include a control system 53 that is in communication with the print head assembly 42 and is configured to facilitate automated control of the operation of the print head assembly 42. In one embodiment, the control system 53 can include a human machine interface (HMI) 54 that can receive a user-input (e.g., through a keyboard or touchscreen) to control certain operations of the printing system 10 (e.g., to initialize printing, stop printing, or change operational parameters of the print head assembly 42).

Figure 3:
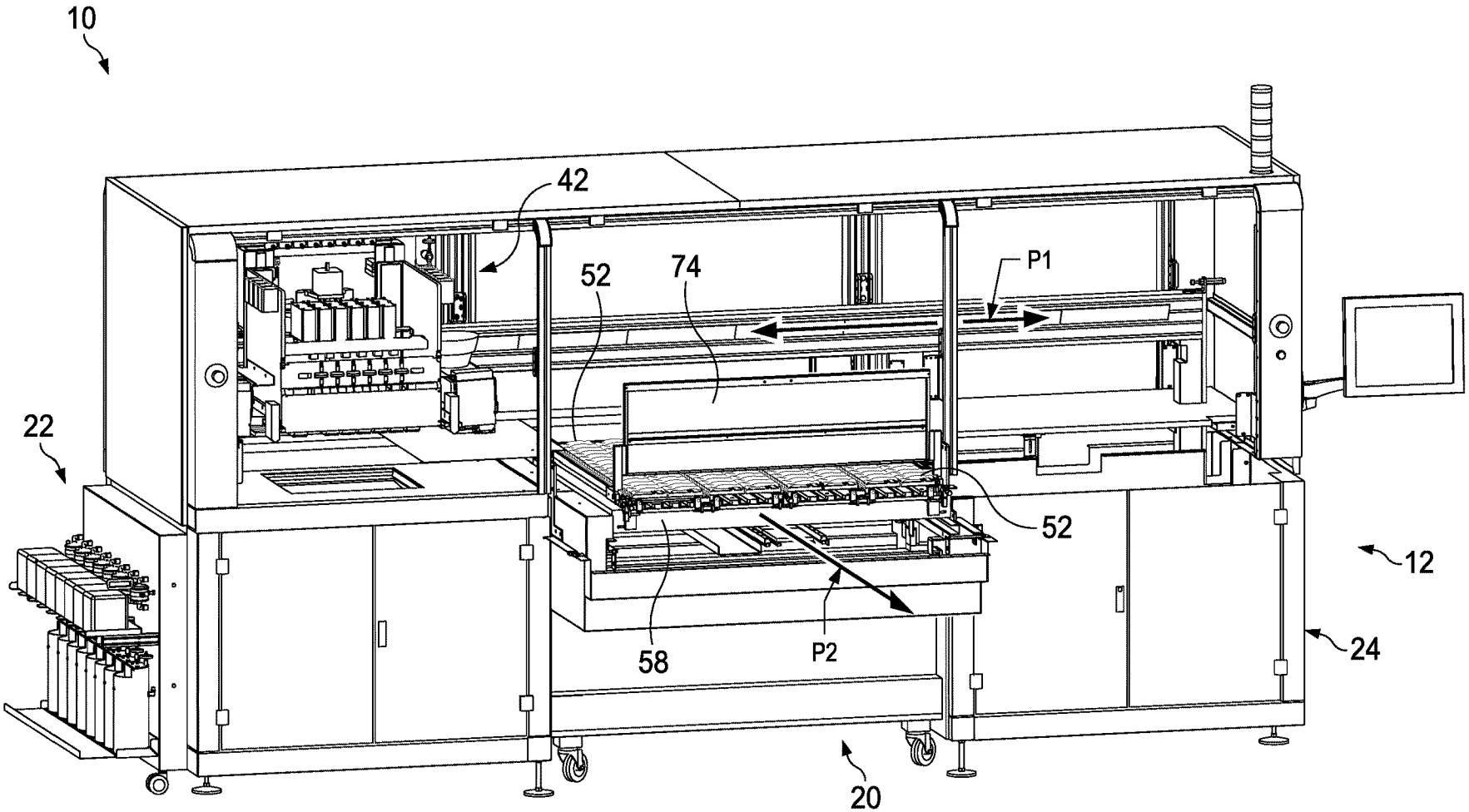
FIG. 3 is an isometric view depicting the printing system of FIG. 2 but with the print bed shown in an extended position.

Referring now to FIGS. 2 and 3, the print bed 50 can be slidable with respect to the base 12 along a lateral path P2 between a retracted position (FIG. 2) and an extended position (FIG. 3). In one embodiment, the print bed 50 can be slidably coupled to the base 12 via slide rails 56 that are interposed between the base 12 and the print bed 50. As illustrated in FIG. 3, when the print bed 50 is slid to the extended position, it can extend from the base 12 such that it is more readily accessible for loading/unloading of the razor handles 52 than when the print bed 50 is in the retracted position. Once the completed razor handles (e.g., 52) have been removed from the print bed 50 and incomplete razor handles 52 loaded thereon, the print bed 50 can be returned to the retracted position, as illustrated in FIG. 2. The central door 30 can then be closed (or reinstalled) and the curtain assembly 36 can be returned to its fully erected position (as illustrated in FIG. 1) in preparation for another printing operation.

Referring now to FIG. 4, the print bed 50 can comprise a lower tray 58 and a carrier assembly 60 that is coupled with the lower tray 58. The carrier assembly 60 can comprise a plurality of carriers 62 (e.g., a set of carriers 62) that are disposed adjacent to each other. Each of the carriers can include a substrate 63 which can support the razor handles 52 that are provided on the print bed 50. Each of the carriers 62 can be individually and selectively removable from the lower tray 58. In one embodiment, each of the carriers 62 can be slidably coupled with the lower tray 58 via a plate 64. In such an embodiment, each of the carriers 62 can be selectively removed from the lower tray 58 by sliding the carrier 62 away from the lower tray 58 enough to separate the carrier 62 from the plate 64.

The print bed 50 can comprise a plurality of locking assemblies 66 that are each configured to selectively retain at least one of the carriers 62 to the print bed 50. For example, when the carriers 62 are installed on the lower tray 58, as illustrated in FIG. 4, the locking assemblies 66 can engage the carriers 62 to prevent them from being removed. To remove one of the carriers 62, the locking assembly 66 associated with that carrier 62 can be unlocked (e.g., by pulling down on the locking assembly 66) which can allow the carrier 62 to slide relative to the lower tray 58 for removal thereof. It is to be appreciated that, although the carriers 62 are described as being slidably coupled with the lower tray 58, any of a variety of suitable alternative coupling arrangements are contemplated that facilitate selective removal of the carriers 62 from the lower tray 58. In one embodiment, as illustrated in FIG. 4, the carrier assembly 60 is shown to comprise four carriers 62 that each support two rows of razor handles. However, other carrier arrangements and quantities are contemplated for facilitating loading and unloading of razor handles 52 with respect to the print bed 50. It is to be appreciated that the lower tray 58 can include any of a variety of suitable alternative substrates (e.g., movable or stationary) for supporting articles. In one embodiment, the lower tray 58 might not include any additional components for support articles such that the lower tray 58 serves as the substrate.

Although one set of carriers 62 is shown and described above, multiple sets of carriers (e.g., 62) can be provided which can streamline the process of loading and unloading razor handles (e.g., 52) to and from the print bed 50 thereby enhancing the throughput of the printer system 10. For example, while a batch of razor handles (e.g., 52) is undergoing printing in the printing system 10 on one set of the carriers 62, another set of the carriers 62 can be loaded with incomplete razor handles (e.g., 52). Once the current printing process is complete, the set of carriers 62 carrying the completed razor handles can be removed from the print bed 50 (e.g., by gaining access to the print bed 50, as described above) and replaced with the set of carriers 62 that is loaded with incomplete razor handles (e.g., 52). In one embodiment, the different sets of carriers 62 can be unloaded/loaded from/to the print bed 50 with the print bed 50 in the extended position. However, in another embodiment, the different sets of carriers 62 can be unloaded/loaded from/to the print bed 50 with the print bed 50 in the retracted position. In any event, once the different sets of carriers 62 are successfully exchanged, the set of carriers 62 loaded with the complete razor handles can be set aside. The printing system 10 can then be returned to a print-ready state (e.g., by closing/installing the central door 30 and erecting the curtain assembly 36) and a new printing operation can again be performed. This process can then be repeated to prepare another set of carriers 62 with incomplete razor handles for the next printing operation.

Figure 5:
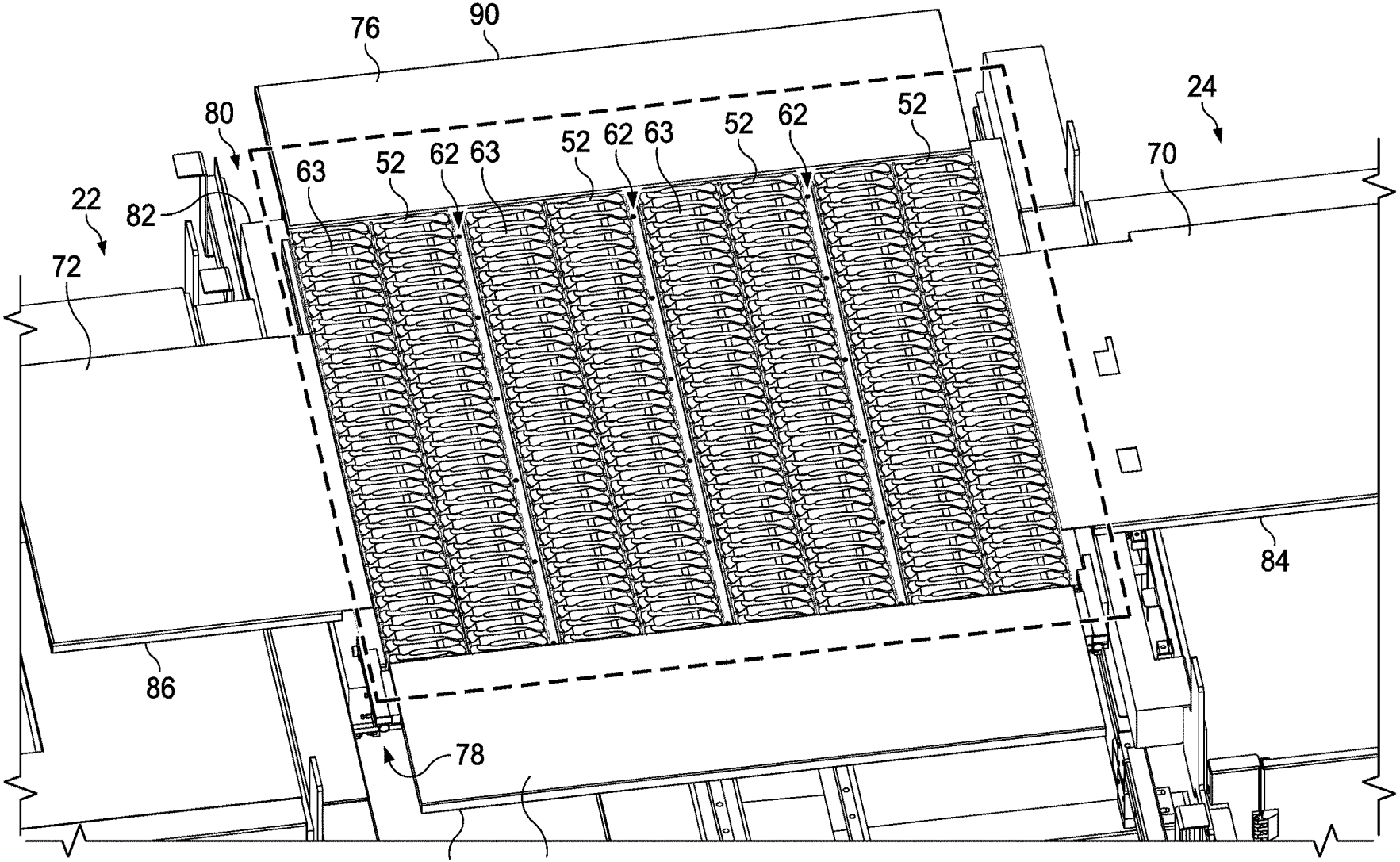
FIG. 5 is an upper isometric enlarged view depicting the printing system of FIG. 2 with certain components removed for clarity of illustration.

Referring now to FIG. 5, the printing system 10 can comprise a right shielding panel 70, a left shielding panel 72, a front shielding panel 74 and a rear shielding panel 76. The right and left shielding panels 70, 72 can be longitudinally spaced from each other and can be coupled with right and left sides 22, 24 of the base 12 adjacent to the lower tray 58 such that the print bed 50 slides with respect to the right and left shielding panels 70, 72 when the print bed 50 is slid between the retracted and extended positions. The front and rear shielding panels 74, 76 can be laterally spaced from each other and can be coupled with respective front and rear sides 78, 80 of the print bed 50 such that the front and rear shielding panels 74, 76 slide together with the print bed 50 when it is slid between the retracted and extended positions. In one embodiment, each of the right and left shielding panels 70, 72 and the rear shielding panel 76 can be rigidly attached to the base 12 and print bed 50, as the case may be, with fasteners (e.g., screws, bolts, or rivets) or any of a variety of other suitable alternative rigid fastening arrangements (e.g., through welding or with adhesive). The front shielding panel 74 can be pivotally coupled with the print bed 50 and can be pivotable between a stowed position (shown in FIGS. 2, 4, and 5) and an upright position (shown in FIG. 3). The front shielding panel 74 can be selectively pivoted into the upright position to allow a user to easily access the carriers 62 for removal and installation thereof.

The lower tray 58 is shown to comprise an outer edge 82 that defines a printing area for the print head assembly 42. The razor handles 52 can be disposed in the printing area for printing by the print head assembly 42. When the print bed 50 is in the retracted position (as illustrated in FIGS. 2 and 5), each of the right, left, front and rear shielding panels 70, 72, 74, 76 can overlie the outer edge 82. In one embodiment, each of the right, left, front and rear shielding panels 70, 72, 74, 76 can extend beyond the outer edge 82 (e.g., overhang) by a distance of between about 1 mm and about 10 mm. As such, the right, left, front and rear shielding panels 70, 72, 74, 76 can be more proximate to the razor handles 52 than the outer edge 82.

It is to be appreciated that when inkjet printing is performed on contoured objects, such as the razor handles 52, the print heads 44 can be spaced further from the print bed 50 than when printing flat objects (e.g., paper). In one embodiment, the distance between the print heads 44 and the razor handles 52 can be about 5 mm whereas the distance between the print heads 44 and a flat object would only be about 1 mm. As such, when the print head assembly 42 moves along the print bed 50 during printing of the razor handles 52, the print head assembly 42 can generate enough turbulence or other fluid disturbance along the print bed 50 that the print quality on the razor handles 52 can be adversely affected more than when printing on flat objects. The right, left, front and rear shielding panels 70, 72, 74, 76, by overlying/overhanging the outer edge 82 of the lower tray 58, can alleviate at least some of the fluid disturbances caused by the movement of the print head assembly 42 which can result in more precise deposition of ink onto the razor handles 52 which can result in clearer images and better print quality than can be provided on contoured surfaces by conventional printing systems.

Still referring to FIG. 5, each of the right, left, front and rear shielding panels 70, 72, 74, 76 can comprise respective upper surfaces 84, 86, 88, 90 that comprise a light absorbent material. In one embodiment, the light absorbent material can comprise a light absorbent foil (e.g., an adhesive-backed foil substrate with a light absorbent upper coating) that overlies, and is adhered to, the right, left, front and rear shielding panels 70, 72, 74, 76. However, in other embodiments, the light absorbent material can be coated, embedded or otherwise provided on the right, left, front and rear shielding panels 70, 72, 74, 76 in any of a variety of suitable alternative application methods.

In one embodiment, the light absorbent material of the upper surfaces 84, 86, 88, 90 can have a hemispherical reflectance of between about 0% and about 5% for a light spectrum range of between about 220 nm and about 400 nm, and preferably between about 1% and about 2% for a light spectrum range of between about 220 nm and about 400 nm. In such an embodiment, the curing lamps 46 can be configured to emit UV light at a light spectrum range that is between about 220 nm and about 400 nm. Some examples of such light absorbent materials can include light absorbent foils such as Acktar Spectral Black Foil or Thorlabs Matte Black Foil.

In one embodiment, the left shielding panel 72 can be provided with a light absorbent material that has enhanced heat resistant properties (e.g., Acktar Spectral Black Foil) and can thus withstand a potential malfunctioning of the curing lamp(s) 46 when the print head assembly 42 is in the home position (FIG. 2). In such an embodiment, the right, front, and rear shielding panels 70, 74, 76 can be provided with less heat resistant light absorbent material (e.g., Thorlabs Matte Black Foil) that is more cost effective than the light absorbent material of the left shielding panel 72.

It is to be appreciated that the turbulence described above that is caused by the movement of the print head assembly 42, though alleviated appropriately by the right, left, front and rear shielding panels 70, 72, 74, 76 to enhance print quality, can still cause air borne ink particles to be present at the print heads 44. When the ink deposited on the razor handles 52 is cured by the curing lamps 46, any stray light that is emitted towards the right, left, front and rear shielding panels 70, 72, 74, 76 can be substantially absorbed by the upper surfaces 84, 86, 88, 90 which can alleviate the opportunity for the airborne ink droplets to be fused onto the print heads 44 and irreversibly damaging the print heads 44 which can be costly to replace. Forming the upper surfaces 84, 86, 88, 90 of a light absorbent material can therefore result in better print head longevity and thus lower operational costs than conventional printing systems that are capable of printing on contoured surfaces. In one embodiment, one or more of the shielding panels 70, 72, 74, 76 can define apertures (not shown) that allow cured ink droplets to fall through the shielding panels 70, 72, 74, 76. In such an embodiment, the apertures can be configured in such a manner that the integrity of the air flow management and UV anti-reflection properties of the shielding panels 70, 72, 74, 76 is not adversely affected.

Figure 6:
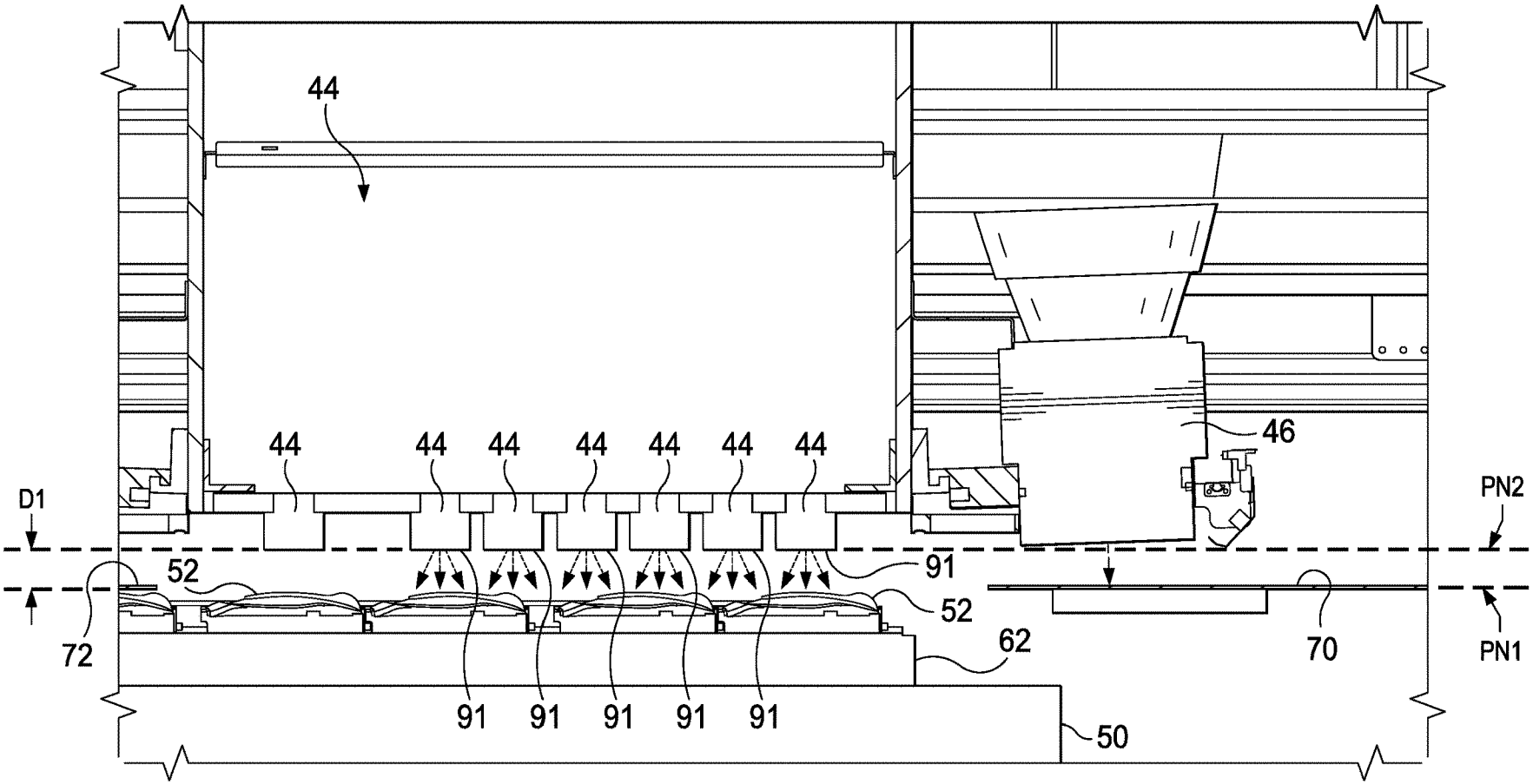
FIG. 6 is an enlarged sectional view taken along the line 6-6 in FIG. 4.

Referring now to FIG. 6, during printing, the print heads 44 are shown to be spaced vertically from the shielding panels 70, 72, 74, 76 by a vertical distance D1 that is between about 1 mm and about 5 mm and preferably about 3 mm. Such a vertical distance can enhance the ability of the shielding panels 70, 72, 74, 76 to effectively reduce stray illumination from the curing lamps 46. The vertical distance D1 is shown to be the distance between a pair of planes PN1 and PN2

The plane PN1 can intersect the upper surface 84 of the right shielding panel 70. Although not explicitly shown in FIG. 6, the plane PN1 can also intersect the upper surface 86 of the left shielding panel 72 and the upper surfaces 88, 90 of the front and rear shielding panels 92, 94. The plane PN1 can be substantially parallel to the longitudinal path PN1 and the lateral path PN2. In one embodiment, the plane PN1 can be substantially horizontal (e.g., with a ground surface). In one embodiment, as illustrated in FIG. 6, the upper surfaces 84, 86, 88, 90 can each be substantially planar and be coplanar with one another such that each of the upper surfaces 84, 86, 88, 90 substantially entirely resides in the plane PN1. It is to be appreciated, however, that in some embodiments one or more of the upper surfaces 84, 86, 88, 90 might be contoured (e.g., non-planar) and/or not planar with each other. In these embodiments, intersection of the plane PN1 with the upper surface(s) 84, 86, 88, 90 can occur at an interior edge of upper surface(s) 84, 86, 88, 90 (e.g., the edge of the upper surface(s) 84, 86, 88, 90 that is most proximate the lower tray 58). It is also to be appreciated that one or more of the shielding panels 70, 72, 74, 76 can be angled with respect to the longitudinal path PN1 and/or the lateral path PN2 to facilitate deflection of airflow away from the print bed 50 to further alleviate at least some of the fluid disturbances caused by the movement of the print head assembly 42.

Still referring to FIG. 6, each of the print heads 44 can comprise a lower surface 91 and the plane PN2 can intersect the lower surfaces 91. It is to be appreciated that the plane PN2 being described as intersecting the lower surfaces 91 can be understood to me that the plane PN2 intersects the lowermost point(s) of the lower surfaces 91 (e.g., the point(s) closest to the lower tray 58). The plane PN2 can be substantially parallel with the plane PN1.

It is to be appreciated that, although the printing system 10 has been described as being suitable for inkjet printing on razor handles 52, the printing system 10 can accommodate any of a variety of suitable alternative contoured objects for inkjet printing thereon.

Figure 7:
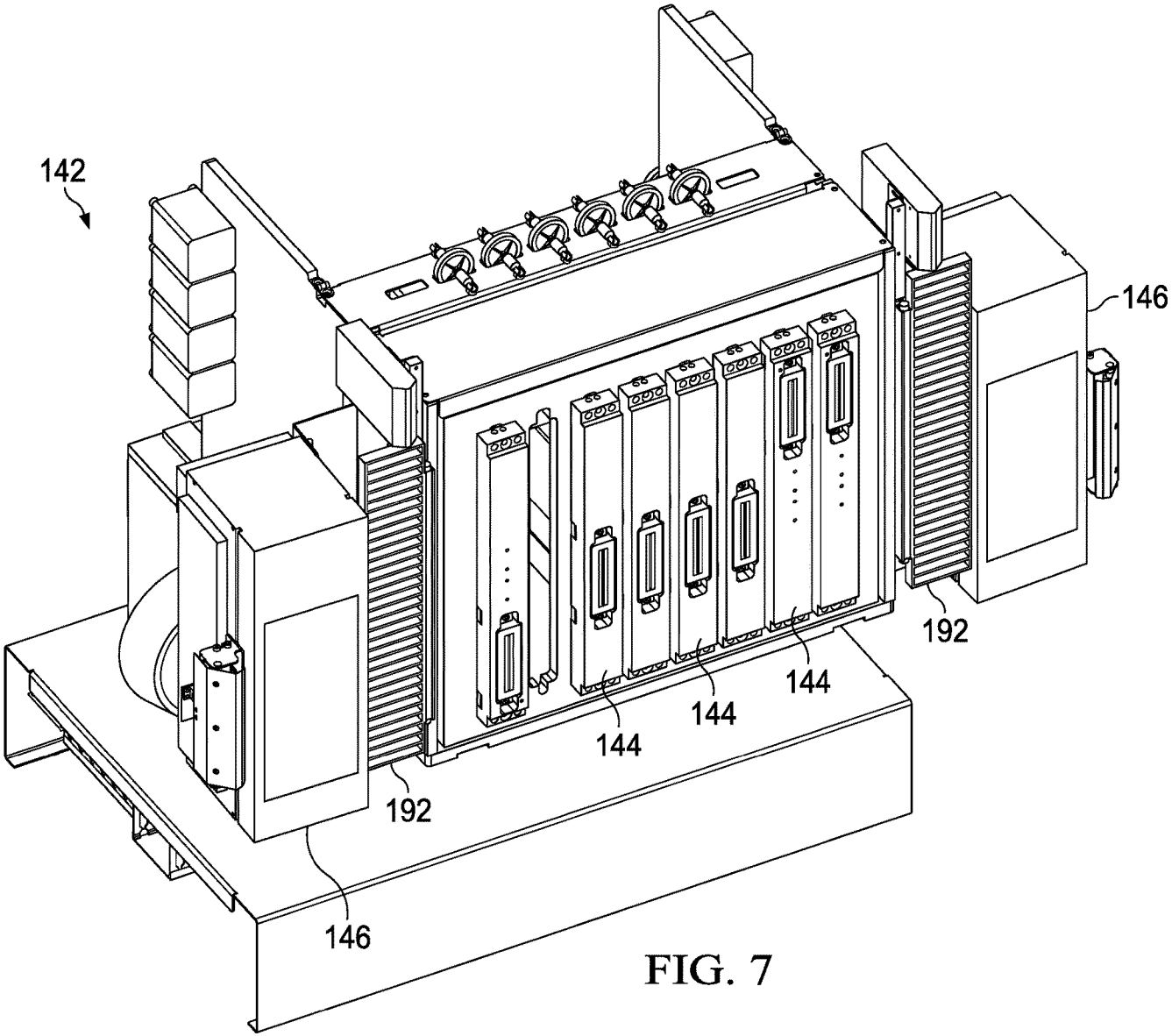
FIG. 7 is an isometric view of a print head assembly, in accordance with another embodiment.

FIG. 7 illustrates an alternative embodiment of a print head assembly 142 that is similar to, or the same as in many respects as, the print head assembly 42 illustrated in FIG. 2. For example, the print head assembly 142 can comprise a plurality of print heads 144 and a plurality of reservoirs (not shown) that each feed ink to at least one of the print heads 144. The print head assembly 142 can also include a pair of curing lamps 146 that are disposed on either side of the print heads 144. However, the print head assembly 142 can include a pair of baffle arrays 192 that are each interposed between one of the curing lamps 146 and the print heads 144. The baffle arrays 192 can absorb stray light from the curing lamps 146 in a similar manner as described above with respect to the upper surfaces 84, 86, 88, 90 and can thus achieve similar results.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION are, in the relevant part, incorporated herein by reference; the citation of any document is not to be construed as an admission that it is prior art with respect to the present disclosure. To the extent that any meaning or definition of a term in this written document conflicts with any meaning or definition in a document incorporated by reference, the meaning or definition assigned to the term in this written document shall govern. Except as otherwise noted, the articles "a," "an," and "the" mean "one or more."

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. In some embodiments, the drawings can be understood to be drawn to scale. The scope of the disclosure is, of course, not limited to the examples or embodiments set forth herein, but can be employed in any number of applications and equivalent devices by those of ordinary skill in the art. Rather it is hereby intended the scope of the disclosure be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A printing system comprising:

a base;

a print head assembly slidably coupled with the base and slidable along a longitudinal path, the print head assembly comprising a print head that is configured to selectively dispense a printing medium therefrom;

a print bed slidably coupled with the base and slidable along a lateral path between a retracted position and an extended position, the print bed comprising a lower tray and a substrate, the lower tray comprising an outer edge and the substrate configured to support an article thereon for printing upon;

and a first shielding panel coupled with the base adjacent to the print bed, the first shielding panel comprising an upper surface, wherein:

the first shielding panel overlies at least a portion of the outer edge of the lower tray when the print bed is in the retracted position; and the upper surface of the first shielding panel is formed of a light absorbent material that has a hemispherical reflectance of between about 0% and about 5% for a light spectrum range of between about 220 nm and about 400 nm.

2. The printing system of claim 1 wherein the light absorbent material has a hemispherical reflectance of between about 1% and about 2% for a light spectrum range of between about 220 nm and about 400 nm.

3. The printing system of claim 1 further comprising a second shielding panel coupled with the base adjacent to the print bed and comprising an upper surface, wherein:

the upper surface of the second shielding panel comprises a light absorbent material that has a hemispherical reflectance of between about 0% and 5% for a light spectrum range of between about 220 nm and about 400 nm;

the base comprises a right side and a left side;

the first shielding panel is coupled with the right side of the base;

the second shielding panel is coupled with the left side of the base and is spaced longitudinally from the first shielding panel;

the first shielding panel overlies at least a portion of the outer edge of the lower tray at the right side of the base when the print bed is in the retracted position;

the second shielding panel overlies at least a portion of the outer edge of the lower tray at the left side of the base when the print bed is in the retracted position; and the print bed slides relative to the first shielding panel and the second shielding panel when the print bed is slid between the retracted position and the extended position.

4. The printing system of claim 3 wherein the light absorbent material of the first shielding panel and the light absorbing material of the second shielding panel each have a hemispherical reflectance of between about 1% and about 2% for a light spectrum range of between about 220 nm and about 400 nm.

5. The printing system of claim 1 wherein the print bed further comprises a carrier assembly that is coupled with the lower tray and facilitates support of an article for printing thereon by the print head assembly.

6. The printing system of claim 5 wherein:

the carrier assembly comprises a plurality of carriers that are slidably coupled with the lower tray; and each carrier of the plurality of carriers is selectively removable from the lower tray.

7. The printing system of claim 6 wherein each carrier of the plurality of carriers is slidably coupled with the tray to facilitate selective removal from the lower tray.

8. The printing system of claim 1 wherein the print head assembly further comprises a curing lamp that is configured to selectively emit light onto the print bed.

9. The printing system of claim 8 wherein the curing lamp is configured to selectively emit light at a light spectrum range of between about 220 nm and about 400 nm.

10. The printing system of claim 1 wherein:

a first plane intersects the upper surface and is substantially parallel with the longitudinal path and the lateral path;

the print head comprises a lower surface;

a second plane intersects the lower surface and is parallel with the first plane; and the first plane is spaced from the second plane by between about 1 mm and about 5 mm.

11. The printing system of claim 10 wherein the first plane is spaced from the second plane by about 3 mm.

12. A printing system comprising:

a base;

a print head assembly slidably coupled with the base and slidable along a longitudinal path, the print head assembly comprising a print head that is configured to selectively dispense a printing medium therefrom;

a print bed slidably coupled with the base and slidable along a lateral path between a retracted position and an extended position, the print bed comprising a lower tray and a substrate, the lower tray comprising an outer edge and the substrate configured to support an article thereon for printing upon; and a first shielding panel coupled with the print bed and comprising an upper surface, wherein:

the first shielding panel overlies at least a portion of the outer edge of the lower tray; and the upper surface of the first shielding panel is formed of a light absorbent material that has a hemispherical reflectance of between about 0% and about 5% for a light spectrum range of between about 220 nm and about 400 nm.

13. The printing system of claim 12 wherein the first shielding panel is pivotally coupled with the print bed and is pivotable between a stowed position and an upright position, and said printing system further comprising a second shielding panel coupled with the print bed and comprising an upper surface, wherein:

the upper surface of the second shielding panel comprises a light absorbent material that has a hemispherical reflectance of between about 0% and about 5% for a light spectrum range of between about 220 nm and about 400 nm;

the print bed comprises a front end and a rear end;

the first shielding panel is coupled with the front end of the print bed;

the second shielding panel is coupled with the rear end of the print bed and is spaced laterally from the first shielding panel;

the first shielding panel overlies at least a portion of the outer edge of the lower tray at the front end of the print bed;

the second shielding panel overlies at least a portion of the outer edge of the lower tray at the rear end of the print bed; and the first shielding panel and the second shielding panel slide together with the print bed when the print bed is slid between the retracted position and the extended position.

14. The printing system of claim 12 wherein the print bed further comprises a carrier assembly that is coupled with the lower tray and facilitates support of an article for printing thereon by the print head assembly.

15. The printing system of claim 14 wherein:

the carrier assembly comprises a plurality of carriers that are slidably coupled with the lower tray; and each carrier of the plurality of carriers is selectively removable from the lower tray.

16. The printing system of claim 12 wherein the print head assembly further comprises a curing lamp that is configured to selectively emit light onto the print bed at a light spectrum range of between about 220 nm and about 400 nm.

17. The printing system of claim 12 wherein:

a first plane intersects the upper surface and is substantially parallel with the longitudinal path and the lateral path;

the print head comprises a lower surface;

a second plane intersects the lower surface and is parallel with the first plane; and the first plane is spaced from the second plane by between about 1 mm and about 5 mm.

18. A printing system comprising:

a base comprising a right side and a left side;

a print head assembly slidably coupled with the base and slidable along a longitudinal path, the print head assembly comprising a print head that is configured to selectively dispense a printing medium therefrom;

a print bed slidably coupled with the base and slidable along a lateral path between a retracted position and an extended position, the print bed comprising a front end, a rear end, a lower tray, and a substrate, the lower tray comprising an outer edge and the substrate configured to support an article thereon for printing upon;

a right shielding panel comprising an upper surface and coupled with the right side of the base such that the print bed slides relative to the right shielding panel;

a left shielding panel comprising an upper surface and coupled with the left side of the base such that the print bed slides relative to the left shielding panel, the left shielding panel being spaced longitudinally from the right shielding panel;

a front shielding panel comprising an upper surface and coupled with the front end of the print bed; and a rear shielding panel comprising an upper surface and coupled with the rear end of the print bed and spaced laterally from the front shielding panel, wherein:

each of the front shielding panel and the rear shielding panel overlies at least a portion of the outer edge of the lower tray;

each of the right shielding panel and the left shielding panel overlies at least a portion of the outer edge of the lower tray when the print bed is in the retracted position; and the upper surface of each of the front shielding panel, the rear shielding panel, the right shielding panel, and the left shielding panel is formed of a light absorbent material that has a hemispherical reflectance of between about 1% and about 2% for a light spectrum range of between about 220 nm and about 400 nm.

19. The printing system of claim 18, further comprising an article for printing, the article being selectively provided on the substrate for printing upon by the print head assembly.

20. The combination of claim 19 wherein, when the article is provided on the substrate, at least a portion of the article is intersected by the second plane, wherein the article comprises a razor handle.

* * * * *